US009084304B2

(12) United States Patent
Baba et al.

(10) Patent No.: US 9,084,304 B2
(45) Date of Patent: Jul. 14, 2015

(54) FAULT CONDITION OF DETECTION CIRCUIT

(71) Applicants: Driss Baba, Swampscott, MA (US); Ayan Choudhury, Danvers, MA (US); Joseph Parisella, Beverly, MA (US)

(72) Inventors: Driss Baba, Swampscott, MA (US); Ayan Choudhury, Danvers, MA (US); Joseph Parisella, Beverly, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 523 days.

(21) Appl. No.: 13/621,358

(22) Filed: Sep. 17, 2012

(65) Prior Publication Data

US 2014/0077704 A1 Mar. 20, 2014

(51) Int. Cl.

*H05B 37/00* (2006.01)
*H05B 37/02* (2006.01)
*H05B 33/08* (2006.01)

(52) U.S. Cl.

CPC ..... *H05B 37/02* (2013.01); *H05B 33/0845* (2013.01)

(58) Field of Classification Search

USPC ..... 315/121, 246, 247, 276–279, 224, 307, 315/308

See application file for complete search history.

(56) References Cited

U.S. PATENT DOCUMENTS 4,613,934 A * 9/1986 Pacholok ..... 363/131
5,656,891 A * 8/1997 Luger et al. ..... 315/94
7,327,101 B1 2/2008 Chen et al.
2004/0130273 A1* 7/2004 Alexandrov ..... 315/291
2007/0296416 A1 12/2007 Lee et al.
2009/0295776 A1* 12/2009 Yu et al. ..... 345/212
2011/0163685 A1* 7/2011 Kumar et al. ..... 315/254

FOREIGN PATENT DOCUMENTS

JP 2004-234923 A 8/2004
JP 2005-100788 A 4/2005
JP 2006-107783 A 4/2006
JP 2008-159599 A 7/2008

OTHER PUBLICATIONS

Underwriters Laboratories, End of Life Protection Certification Notice LP No. 48, UL 1993, pp. 1-27.

Chang Gyun Kim, International Search Report and Written Opinion of the International Searching Authority for PCT/US11/20611, Aug. 29, 2011, pp. 1-7, Korean Intellectual Property Office, Daejeon, Republic of Korea.

* cited by examiner

*Primary Examiner* — James H Cho
(74) *Attorney, Agent, or Firm* — Shaun P. Montana

(57) ABSTRACT

A ballast comprises an inverter having a transformer comprising a core, a primary winding, and a secondary winding for connecting to a lamp and providing voltage thereto. The ballast includes a fault condition detection circuit connected to the inverter for disabling the inverter to discontinue energization of the lamp when a fault condition occurs. The fault condition detection circuit comprises an other primary winding wound on the core of the transformer for receiving a voltage signal proportional to a voltage across the secondary winding, a voltage blocking circuit connected to the other primary winding for receiving the voltage signal from the other primary winding, and a capacitor connected between the voltage blocking circuit and ground potential. The voltage blocking circuit is configured to selectively conduct and block the received voltage signal as a function of the frequency of the received voltage signal.

20 Claims, 3 Drawing Sheets

FAULT CONDITION OF DETECTION CIRCUIT

TECHNICAL FIELD

The present invention relates to lighting, and more specifically, to electronic ballasts for lighting.

BACKGROUND

A typical ballast provides regulated power to a lamp. Low pressure and high pressure discharge lamps, such as fluorescent lamps and sodium-based lamps, use a ballast to provide the proper starting voltage for the lamp and to limit the operating current once the lamp is ignited. Generally, a ballast is configured to provide appropriate and consistent power to the lamp(s) connected thereto. However, there are fault conditions that may occur in a lighting system, during which the continued supply of power to the lamps is undesirable and potentially dangerous. For example, during the end of life (EOL) stage of a fluorescent lamp, the lamp's end caps may overheat due to a depletion of an emission mix in the filament and due to the small spacing between the cathode and lamp wall. When this occurs, one or both of the lamp's end caps may exceed a design temperature limit and detrimentally affect the reliability of the lamp. These conditions may cause the lamp to crack. Another fault condition associated with the lamp is an arcing condition. This occurs when a small gap persists between the lamp's end caps and the socket in which the lamp is located. Arcing can lead to fire and other injuries.

SUMMARY

Given the potential dangers posed by the occurrence of fault conditions in lamps operated by ballasts, there is a need for a ballast to be able to detect fault conditions and to shut down the associated lamps as needed.

Embodiments of the present invention provide a fault condition detection circuit for a ballast that detects a fault condition and, in response, discontinues the energization of any lamps connected to the ballast. In some embodiments, a ballast comprises a rectifier for receiving an alternating current (AC) voltage signal from a power source and producing a rectified voltage signal therefrom. A power factor correction circuit receives the rectified voltage signal and provides a corrected voltage signal. An inverter circuit receives the corrected voltage signal and provides a lamp voltage to the one or more lamps for energizing the one or more lamps. The inverter circuit includes a transformer for providing voltage to the one or more lamps. In particular, the transformer comprises a core, a primary winding wound on the core and connected to the power factor correction circuit, and a secondary winding wound on the core for connecting to the one or more lamps. A fault condition detection circuit is connected to the inverter circuit for disabling the operating of the inverter circuit and thereby discontinuing energization of the one or more lamps when a fault condition occurs. The fault detection circuit comprises an other primary winding wound on the core of the transformer for receiving a voltage signal proportional to a voltage across the secondary winding. A high pass filter is connected to the other primary winding for receiving the voltage signal from the other primary winding. The high pass filter is configured to pass the received voltage signal when the received voltage signal has a frequency exceeding a threshold frequency associated with normal operation and to block the received voltage signal when the received voltage signal has a frequency less than or equal to the threshold frequency associated with normal operation. A capacitor is connected between the high pass filter and ground potential for receiving the voltage signal passed from the high pas filter and for storing a voltage in response thereto. An output terminal is connected to the inverter circuit for providing a disabling signal to the inverter circuit based on the voltage stored by the capacitor.

In an embodiment, there is provided a ballast. The ballast includes: an inverter circuit to selectively energize one or more lamps, the inverter circuit having a transformer to provide voltage to the one or more lamps, wherein the transformer includes: a core; a primary winding wound on the core and connected to a direct current (DC) voltage bus; and a secondary winding wound on the core to connect to the one or more lamps; and a fault condition detection circuit connected to the inverter circuit to disable operation of the inverter circuit and thereby discontinue selective energization of the one or more lamps when a fault condition occurs, the fault condition detection circuit comprising: an other primary winding wound on the core of the transformer to receive a voltage signal proportional to a voltage across the secondary winding, the other primary winding having a first terminal and a second terminal, wherein the second terminal of the primary winding is connected to ground potential; a voltage blocking circuit connected to the first terminal of the other primary winding to receive the voltage signal from the other primary winding, the voltage blocking circuit configured to selectively conduct and block the received voltage signal as a function of the frequency of the received voltage signal; a capacitor connected between the voltage blocking circuit and ground potential to receive the conducted voltage signal from the voltage blocking circuit and to store a voltage in response thereto; wherein the voltage blocking circuit is configured to conduct the voltage signal received by the voltage blocking circuit and provide the conducted voltage signal to the capacitor when the frequency of the voltage signal received by the voltage blocking circuit exceeds a threshold frequency associated with normal operation of the one or more lamps; wherein the voltage blocking circuit is configured to block the voltage signal received by the voltage blocking circuit when the frequency of the voltage signal received by the voltage blocking circuit is less than or equal to the threshold frequency associated with normal operation of the one or more lamps; and an output terminal connected to the inverter circuit to provide a disabling signal to the inverter circuit based on the voltage stored by the capacitor.

In a related embodiment, the capacitor connected between the voltage blocking circuit and ground potential may be a first capacitor, and the voltage blocking circuit may include a second capacitor and a diode, the second capacitor and the diode connected together in series. In another related embodiment, the fault condition detection circuit may further include an operational amplifier connected between the capacitor and the output terminal to amplify the voltage stored by the capacitor. In a further related embodiment, the operational amplifier may be a differential operational amplifier having a non-inverting input terminal, an inverting input terminal, and an output terminal, and the fault condition detection circuit may further include a voltage supply connected between the inverting input terminal of the operational amplifier and ground potential, the non-inverting input terminal of the operational amplifier may be connected to the capacitor, and the output terminal of the operational amplifier may be connected to the output terminal of the fault condition detection circuit. In a further related embodiment, the fault condition detection circuit may further include a diode connected between the output terminal of the operational amplifier and the output terminal of the fault condition detection circuit. In another further related embodiment, the fault condition detection circuit may further include a resistor-capacitor circuit connected between the output terminal of the operational amplifier and the output terminal of the fault condition detection circuit. In a further related embodiment, the fault condition detection circuit may further include a diode having an anode and a cathode, the anode may be connected to the output terminal of the operational amplifier and the cathode may be connected to the resistor-capacitor circuit.

In yet another related embodiment, the threshold frequency associated with normal operation may be substantially 45 kilohertz. In still another related embodiment, the ballast may further include: a rectifier to receive an alternating current (AC) voltage signal from a power source and to produce a rectified voltage signal therefrom; and a power factor correction circuit to receive the rectified voltage signal and to provide a corrected voltage signal; wherein the inverter circuit may be connected to the power factor correction circuit via the DC voltage bus to receive the corrected voltage signal therefrom.

In another embodiment, there is provided a ballast. The ballast includes: an inverter circuit to selectively energize one or more lamps, the inverter circuit having a transformer to provide voltage to the one or more lamps, wherein the transformer includes: a core; a primary winding wound on the core and connected to a direct current (DC) voltage bus; and a secondary winding wound on the core for connecting to the one or more lamps; and a fault condition detection circuit connected to the inverter circuit to disable operation of the inverter circuit and thereby discontinue energization of the one or more lamps when a fault condition occurs, the fault condition detection circuit includes: an other primary winding wound on the core of the transformer to receive a voltage signal proportional to a voltage across the secondary winding, the other primary winding having a first terminal and a second terminal, wherein the second terminal of the primary winding is connected to ground potential; a high pass filter connected to the first terminal of the other primary winding to receive the voltage signal from the other primary winding, the high pass filter configured to pass the received voltage signal when the received voltage signal has a frequency exceeding a threshold frequency associated with normal operation and to block the received voltage signal when the received voltage signal has a frequency less than or equal to the threshold frequency associated with normal operation; a capacitor connected between the high pass filter and ground potential to receive the voltage signal passed from the high pass filter and to store a voltage in response thereto; and an output terminal connected to the inverter circuit to provide a disabling signal to the inverter circuit based on the voltage stored by the capacitor.

In a related embodiment, the capacitor connected between the high pass filter and ground potential may be a first capacitor, and the high pass filter may include a second capacitor. In a further related embodiment, a diode may be connected between the first capacitor and the second capacitor.

In another related embodiment, the fault condition detection circuit may further include an operational amplifier connected between the capacitor and the output terminal to amplify the voltage stored by the capacitor. In a further related embodiment, the operational amplifier may be a differential operational amplifier having a non-inverting input terminal, an inverting input terminal, and an output terminal, and the fault condition detection circuit may further include a voltage supply connected between the inverting input terminal of the operational amplifier and ground potential, the non-inverting input terminal of the operational amplifier may be connected to the capacitor, and the output terminal of the operational amplifier may be connected to the output terminal of the fault condition detection circuit. In a further related embodiment, the fault condition detection circuit may further include a resistor-capacitor circuit connected between the output terminal of the operational amplifier and the output terminal of the fault condition detection circuit. In another further related embodiment, the fault condition detection circuit may further include a diode connected between the output terminal of the operational amplifier and the output terminal of the fault condition detection circuit. In a further related embodiment, the fault condition detection circuit may further include a diode having an anode and a cathode, the anode may be connected to the output terminal of the operational amplifier and the cathode may be connected to the resistor-capacitor circuit.

In still another related embodiment, the threshold frequency associated with normal operation may be substantially 45 kilohertz.

In another embodiment, there is provided a ballast. The ballast includes: a rectifier to receive an alternating current (AC) voltage signal from a power source and to produce a rectified voltage signal therefrom; a power factor correction circuit to receive the rectified voltage signal and to provide a corrected voltage signal; an inverter circuit to receive the corrected voltage signal and to provide a lamp voltage to energize one or more lamps, the inverter circuit having a transformer to provide voltage to the one or more lamps, wherein the transformer includes: a core; a primary winding wound on the core and connected to the power factor correction circuit; and a secondary winding wound on the core to connect to the one or more lamps; and a fault condition detection circuit connected to the inverter circuit to disable operation of the inverter circuit and thereby discontinue energization of the one or more lamps when a fault condition occurs, the fault condition detection circuit includes: an other primary winding wound on the core of the transformer to receive a voltage signal proportional to a voltage across the secondary winding, the other primary winding having a first terminal and a second terminal, wherein the second terminal of the primary winding is connected to ground potential; a high pass filter connected to the first terminal of the other primary winding to receive the voltage signal from the other primary winding, the high pass filter configured to pass the received voltage signal when the received voltage signal has a frequency exceeding a threshold frequency associated with normal operation and to block the received voltage signal when the received voltage signal has a frequency less than or equal to the threshold frequency associated with normal operation; a capacitor connected between the high pass filter and ground potential to receive the voltage signal passed from the high pass filter and to store a voltage in response thereto; and an output terminal connected to the inverter circuit to provide a disabling signal to the inverter circuit based on the voltage stored by the capacitor.

In a related embodiment, the capacitor connected between the high pass filter and ground potential may be a first capacitor, and the high pass filter may include a second capacitor, and the ballast may further include a diode connected between the first capacitor and the second capacitor.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
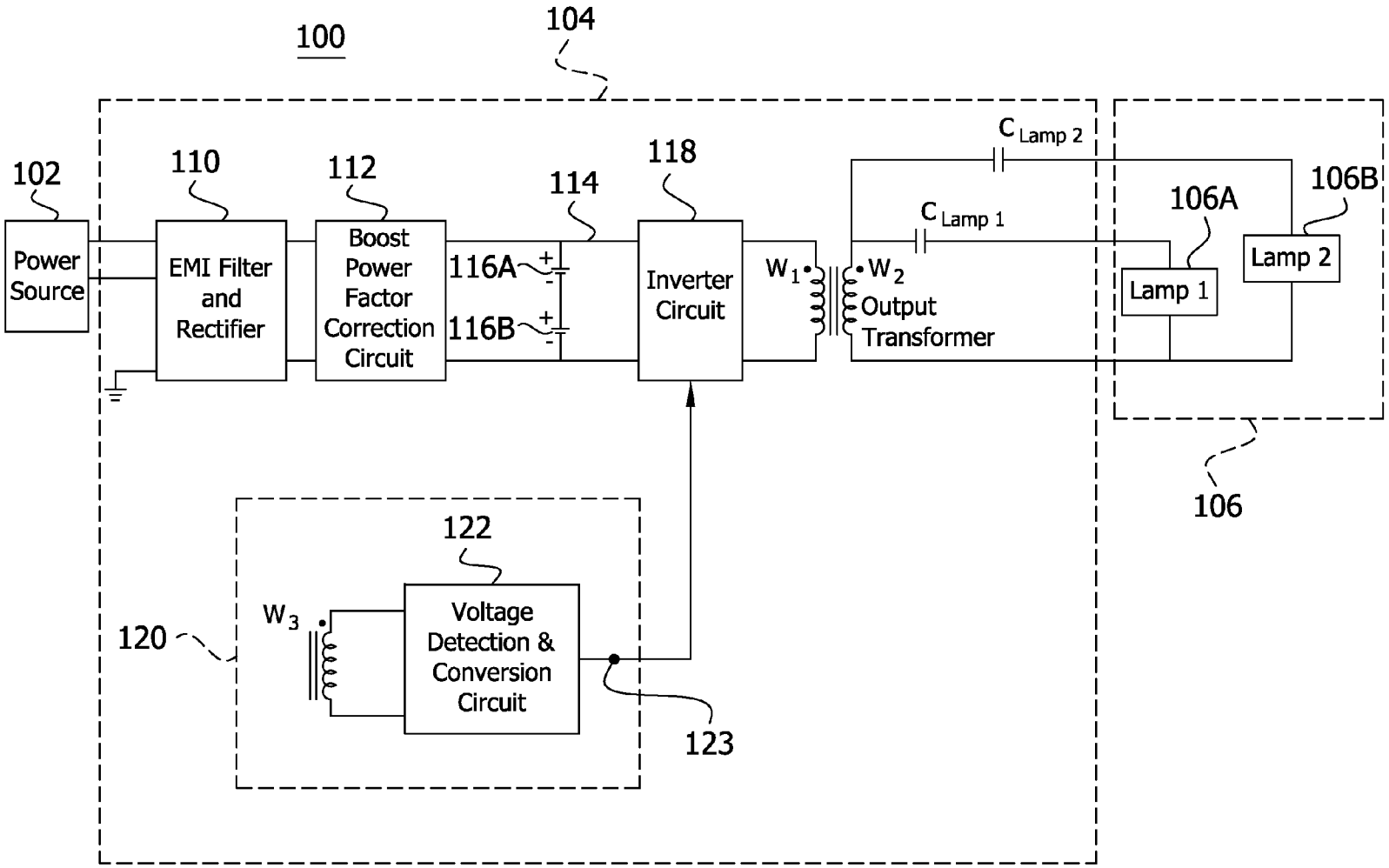
FIG. 1 shows a partial schematic, partial block diagram of a lamp system having a ballast for use with an input power source to energize a lamp according embodiments disclosed herein.

FIG. 1 shows a lamp system 100, which includes an input power source 102, such as but not limited to an alternating current (AC) power source, an electronic ballast 104, and a lamp 106. Although the lamp 106 is illustrated as two lamps 106A and 106B, the lamp 106 may be one lamp or a plurality of lamps connected together in parallel. In some embodiments, the lamp 106 is a fluorescent lamp, such as but not limited to a T8 fluorescent lamp, such as but not limited to a model number FT40DL available from OSRAM SYLVANIA Inc. of Danvers, Mass. However, it should be noted that the lamp system 100 may be used to energize other types of lamps without departing from the scope of the invention.

The ballast 104 includes one or more input terminals adapted for connecting to the input power source 102 and a ground terminal connectable to ground potential. In some embodiments, the input power source 102 includes a first voltage source and a second voltage source. The ballast 104 is operatively connected to either the first voltage source or the second voltage source. Thus, the ballast 104 may selectively receive power from either the first voltage source (e.g., 208 volts AC) or the second voltage source (e.g., 347 volts, 480 volts). Other input power sources 102 known in the art may be used without departing from the scope of the present invention. Although the ballast 104 as shown in FIG. 1 is configured as an instant start ballast, other ballasts may be used in connection with the aspects described below without departing from the scope of the invention.

The ballast 104 receives an input AC power signal from the input power source 102 via the input terminal. In some embodiments, the ballast 104 includes an electromagnetic interference (EMI) filter and a rectifier (e.g., full-wave rectifier), illustrated generally at 110. The EMI filter prevents noise, which may be generated by the ballast 104, from being transmitted back to the input power source 102. The rectifier converts AC voltage of the input power signal to DC (direct current) voltage.

The ballast 104 includes a power stage for converting power supplied by the input power source 102 to drive the lamp 106. In FIG. 1, the ballast 104 includes a boost power factor correction circuit 112 and a DC voltage bus 114 as the power stage, though of course other known power stage configurations may be, and in some embodiments are, used. The boost power factor correction circuit 112 receives the rectified input power signal and produces a high DC voltage (e.g., 450 volts DC). The high DC voltage is then sent to the DC voltage bus 114, which is connected to an output of the boost power factor correction circuit 112. An inverter circuit 118, such as but not limited to a current fed half bridge inverter and start up circuit, is connected to the DC voltage bus 114 and converts the DC voltage to an AC voltage suitable for selectively energizing the lamps 106 (i.e., the lamp 106A and the lamp 106B). One or more capacitors, such as electrolytic capacitors 116A and 116B, may be connected in a shunt configuration across the output of the boost power factor correction circuit 112 to provide a low impedance source of voltage to the inverter circuit 118. The inverter circuit 118 includes an output transformer having a primary winding W1 and a secondary winding W2 for providing voltage to the lamps 106. A lamp capacitor $C_{Lamp1}$, $C_{Lamp2}$ is connected in series with each lamp 106A, 106B between the output transformer and the lamp 106A, 106B for defining current provided to the respective lamp 106A, 106B.

The ballast 104 also includes a fault condition detection circuit 120 for detecting a fault condition associated with one or more of the lamps 106. When the fault condition detection circuit 120 detects the occurrence of a fault, such as but not limited to one of the lamps 106 breaking, the fault condition detection circuit 120 shuts down (i.e., disables) the inverter circuit 118 so that energization of the lamps 106 is discontinued. A fault condition occurs when the ballast 104 does not behave in an expected manner for any reason that is caused, in part, by a lamp 106. Thus, a fault condition may occur when a component of the ballast 104 suffers a total failure (e.g., the component ceases to function properly and must be replaced by a new, proper functioning component) as well as when a component of the ballast 104 suffers an intermittent transient failure (e.g., the component functions properly, then fails to function properly, but resumes proper functioning without any outside action being taken). For example, a fault condition may include the occurrence of a lamp 106 reaching the end of its life due to degradation of filaments. This condition is commonly referred to as "End of Life lamp (EOLL)" or "Diode mode lamp". A fault condition may also include arcing between a pin of one of the lamps 106 and the lamp connector/holder into which that lamp 106 is placed, because of a small persistent gap between the pin and the lamp connector/holder.

In the lamp system 100, the fault condition detection circuit 120 includes an other primary winding (hereinafter "detect winding") W3 of the output transformer, a voltage detection and conversion circuit 122, and an output terminal 123 connecting the fault condition detection circuit 120 to the inverter circuit 118. The detect winding W3 is coupled (e.g., magnetically coupled) with the primary winding W1 since they are wound on the same core. Accordingly, the detect winding W3 generates a voltage signal (also referred to throughout as a "detect winding signal") that is proportional to the voltage across the secondary winding W2. In other words, the voltage across the secondary winding W2 is reflected in the voltage across the detect winding W3. In some embodiments, the voltage across the secondary winding W2, and thereby the voltage across the detect winding W3, oscillates during normal operation of the lamp(s) 106 at a frequency substantially similar to that of the lamp voltage. For example, the voltage across the primary winding W1, the secondary winding W2, and the detect winding W3 oscillates at a frequency of substantially 45 KHz during normal operation. As further described below, a fault condition associated with a lamp 106 causes an increase in the frequency of the voltage signal across the secondary winding W2 relative to the frequency of the voltage signal across the secondary winding W2 during normal operation of the lamp(s) 106. Since the voltage across the secondary winding W2 is reflected in the voltage across the detect winding W3, the frequency of the voltage signal across the detect winding W3 likewise increases during a fault condition relative to the frequency of the voltage signal across the detect winding W3 during normal operation of the lamp(s) 106. Thus, the detect winding W3 of the fault condition detection circuit 120 indicates a fault condition associated with a lamp(s) 106 via an increase in the frequency of the detect winding signal. The voltage detection and conversion circuit 122 is connected to the detect winding W3 and to the inverter circuit 118 via the output terminal 123. In operation, the voltage detection and conversion circuit 122 detects the increase in the frequency of the detect winding signal, and converts its output voltage to a voltage (i.e., shutdown signal) suitable for disabling the inverter circuit 118.

Figure 2:
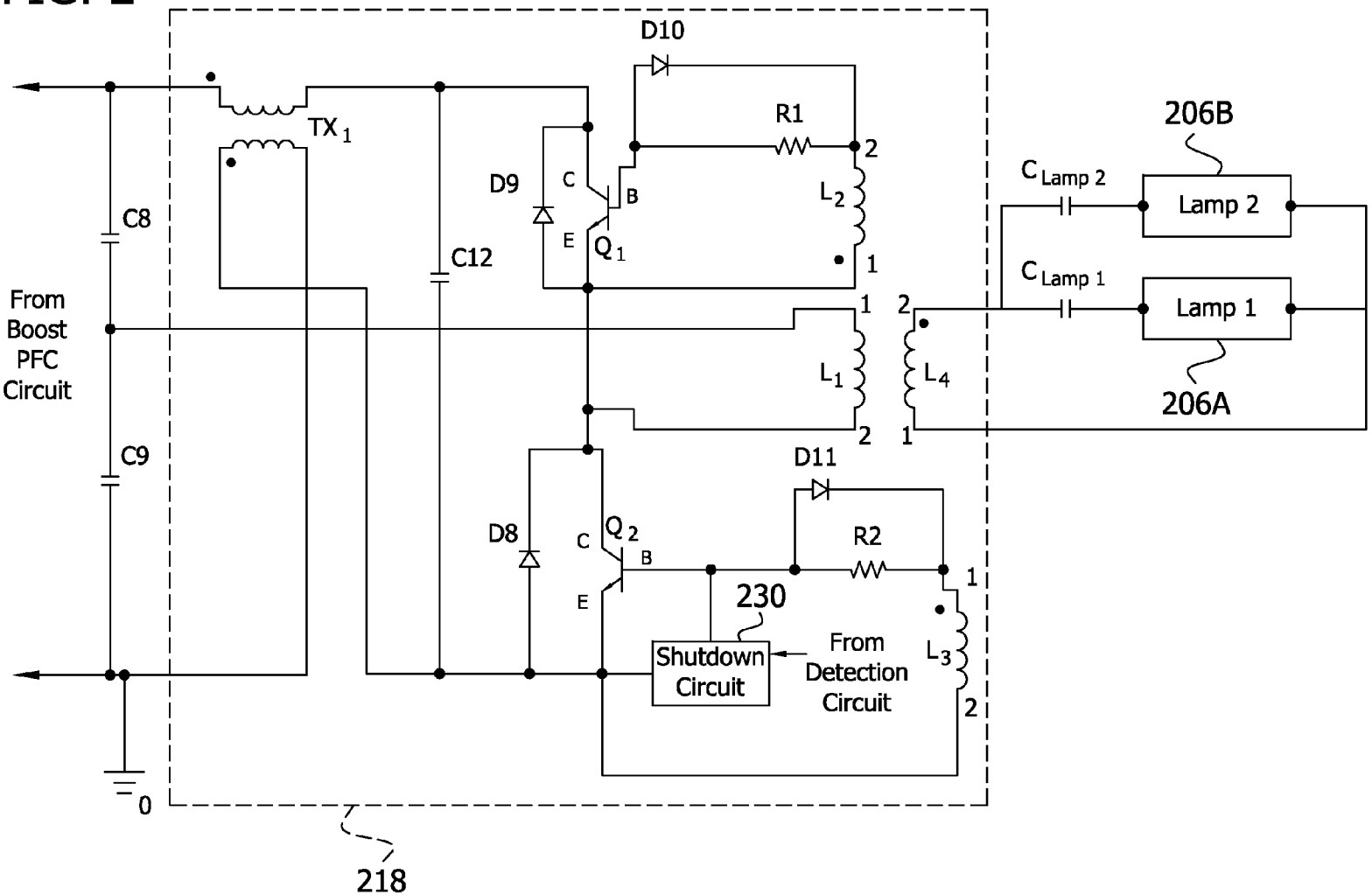
FIG. 2 is a circuit schematic of an inverter circuit of a ballast according to embodiments disclosed herein.

FIG. 2 illustrates a schematic of an exemplary inverter circuit 218 for a lamp system. As described above with regards to the inverter circuit 118 shown in FIG. 1, the inverter circuit 218 converts DC voltage to AC voltage for energizing lamps 206A, 206B. As shown in FIG. 2, the inverter circuit 218 is a half-bridge resonant inverter, though of course other types of inverter circuits may be, and in some embodiments are, used. In particular, the inverter circuit 218 includes a first switch Q1 and a second switch Q2 for oppositely operating between a conductive state and a non-conductive state in order to provide an AC voltage to the lamps 206A, 206B as generally known in the art. The first switch Q1 and the second switch Q2 are each transistors having a base terminal B, an emitter terminal E, and a collector terminal C. A resistor R1 and a diode D10 are connected together in parallel to the base terminal B of the first switch Q1. Similarly, a resistor R2 and a diode D11 are connected together in parallel to the base terminal B of the second switch Q2. The resistor R1 and the resistor R2 each limit the base current to their respective switch (i.e., the first switch Q1 and the second switch Q2) when that respective switch (i.e., the first switch Q1 and the second switch Q2) is operating in its conductive state. The diode D10 and the diode D11 each discharge the base current from the respective switch (i.e., the first switch Q1 and the second switch Q2) when that respective switch (i.e., the first switch Q1 and the second switch Q2) is operating in its non-conductive mode. The inverter circuit 218 additionally includes a current choke transformer $TX_1$, and an output transformer as generally described above in regards to FIG. 1. The output transformer has five windings, $L_1$, $L_2$, $L_3$, $L_4$, and $L_6$ ($L_6$ not shown in FIG. 2), which are all wound on the same core. In particular, the output transformer includes a primary winding $L_1$ and a secondary winding $L_4$, which are described above in connection with the lamp system 100 of FIG. 1 as the primary winding W1 and the secondary winding W2, respectively. A winding $L_2$ and a winding $L_3$ provide base drives for the first switch Q1 and the second switch Q2, respectively. A winding $L_6$ is another primary winding that forms the detect winding included in the fault condition detection circuit 120 described above in regards to FIG. 1.

The inverter circuit 218 includes a shutdown circuit 230 connected between the base B and the emitter E of the second switch Q2 and connected to the fault condition detection circuit 120. For example, in some embodiments the shutdown circuit 230 includes a shutdown switch Q3 (not shown), such as but not limited to a silicon-controlled rectifier (SCR) latch, connected between the base B and the emitter E of the second switch Q2. When a fault is detected, the fault condition detection circuit 120 generates a shutdown signal from the increase in frequency of the detect winding signal. The shutdown signal is received by the shutdown switch Q3, causing the shutdown switch Q3 to turn on (i.e., operate in a conductive state), thereby shorting the base B and the emitter E of the second switch Q2 of the inverter circuit 218. This causes the inverter circuit 218 to discontinue the energization of the lamps 206A and 206B.

Figure 3:
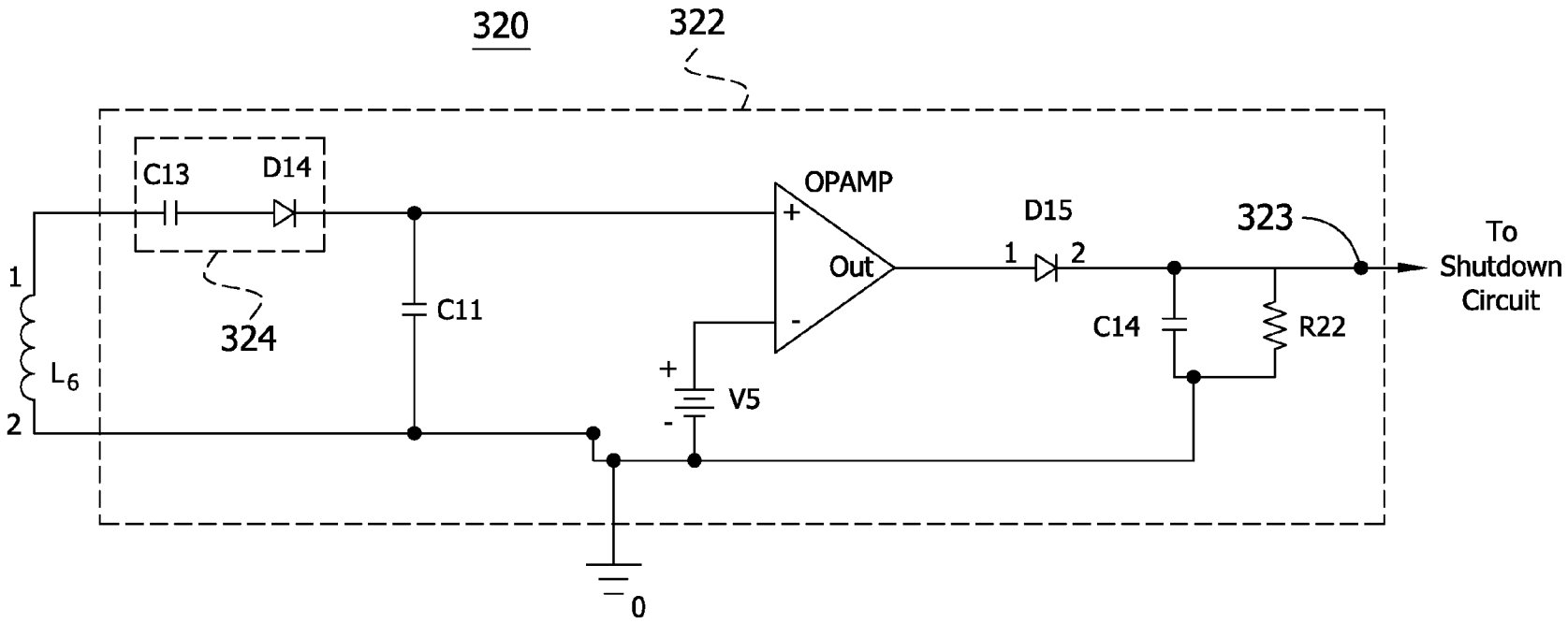
FIG. 3 is a circuit schematic of a fault condition detection circuit of a ballast according to embodiments disclosed herein.

FIG. 3 is a schematic diagram of a fault condition detection circuit 320. In FIG. 3, the detect winding $L_6$ has a first terminal connected to a voltage blocking circuit 324, and a second terminal connected to ground potential. A capacitor C11 is connected between the voltage blocking circuit 324 and ground potential. The voltage blocking circuit 324 is configured to selectively conduct and block the detect winding signal as a function of the frequency of the detect winding signal. The capacitor C11 (also referred to throughout broadly as a storage component), connected to the voltage blocking circuit 324, receives voltage signals conducted by the voltage blocking circuit 324 and stores a voltage in response thereto. In some embodiments, the voltage blocking circuit 324 is configured to conduct voltage signals having a frequency greater than a threshold frequency associated with normal operation of the lamp(s) operated by the ballast that includes the fault condition detection circuit 320. In some embodiments, the voltage blocking circuit 324 is configured to block voltage signals having a frequency less than or equal to the threshold frequency associated with the normal operation of the lamp(s) operated by the ballast that includes the fault condition detection circuit 320. Thus, in operation of some embodiments, the voltage blocking circuit 324 conducts the detect winding signal, providing voltage to the capacitor C11 when the detect winding signal has a frequency greater than the threshold frequency associated with the normal operation of the lamp(s) operated by the ballast that includes the fault condition detection circuit 320. Similarly, in operation of some embodiments, the voltage blocking circuit 324 blocks the detect winding signal, thereby blocking voltage from the capacitor C11 when the detect winding signal has a frequency less than or equal to the threshold frequency associated with the normal operation of the lamp(s) operated by the ballast that includes the fault condition detection circuit 320. Accordingly, a high voltage (i.e., voltage exceeding a threshold voltage) is generated across the capacitor C11 in response to an occurrence of a fault condition, whereas a minimal voltage (e.g., substantially 0 Volts) exists across the capacitor C11 during normal operation of the lamp(s) operated by the ballast that includes the fault condition detection circuit 320. The voltage generated across the capacitor C11, which may be conditioned/converted as explained below, is fed to the shutdown circuit 230 of FIG. 2, causing it to disable the inverter circuit of the ballast that includes the fault condition detection circuit 320.

In FIG. 3, the voltage blocking circuit 324 is comprised of a capacitor C13 and a diode D14 connected together in series. The capacitor C13 operates as a high pass filter that passes (e.g., conducts) signals exceeding the threshold frequency, and blocks signals having other frequencies (i.e., less than or equal to the threshold frequency). The diode D14 rectifies the signals conducted by the capacitor C13, and the rectified signals are provided to the capacitor C11. Thus, in some embodiments, the voltage blocking circuit 324 rectifies the detect winding signal, and provides the rectified detect winding signal to the capacitor C11 only when the detect winding signal has a frequency exceeding the threshold frequency value. The rectified detect winding signal received by the capacitor C11 charges the capacitor C11 so that at least a threshold voltage is stored by the capacitor C11, and this threshold voltage causes the shutdown circuit 230 to disable the inverter circuit of the ballast that includes the fault condition detection circuit 320.

The voltage detection and conversion circuit 322 may, in some embodiments does, also include additional components for conditioning/converting the voltage stored by the capacitor C11 to a voltage suitable for disabling the inverter circuit of the ballast that includes the fault condition detection circuit 320. In some embodiments, an operational amplifier OPAMP amplifies the voltage stored by the capacitor C11. As generally known, the operational amplifier OPAMP has a non-inverting input terminal, an inverting input terminal, and an output terminal. The non-inverting input terminal is connected to the capacitor C11, and a voltage supply V5 is connected to the inverting input terminal. The operational amplifier OPAMP amplifies the difference between the voltage stored by the capacitor C11 and the voltage supply V5. The voltage supply V5 is a small voltage (e.g., 5 Volts) selected to cancel out any noise that may be present at the non-inverting input terminal. As such, the operational amplifier OPAMP generates an amplified voltage signal from the voltage stored by the capacitor C11 only when the voltage stored by the capacitor C11 exceeds the voltage provided by the voltage supply V5. Accordingly, the operational amplifier OPAMP prevents false triggering of the shutdown circuit 230 due to noise.

In some embodiments, a diode D15 is connected between the voltage blocking circuit 324 and the shutdown circuit 230. In operation, the diode D15 holds the voltage signal generated by the operational amplifier OPAMP for a short period of time after the fault condition occurrence, so that it is not discharged through the operational amplifier OPAMP output terminal when the fault is intermittently cleared. In some embodiments, a resistor-capacitor (RC) circuit is additionally and/or alternatively connected between the voltage blocking circuit 324 and the shutdown circuit 230 for holding a voltage at the output terminal 323 of the fault detection condition circuit 320 for a finite period of time, which enables the shutdown circuit 230 to be activated. In FIG. 3, a capacitor C14 and a resistor R22 are connected together in parallel forming an RC circuit between a cathode of the diode D15 and the output terminal 323 of the fault condition detection circuit 320. The diode D15 supplies voltage to the RC circuit (R22, C14), and the RC circuit (R22, C14) accordingly holds a voltage at the output terminal 323 for finite period of time. As is generally known in the art, the finite period of time is defined by the RC circuit time constant ("R22-C14 time constant"). Thus, the capacitor C14 and the resistor R22 are selected so that the R22-C14 time constant provides voltage to the shutdown circuit 230 for a finite period of time that is long enough for the shutdown circuit 230 to short the base B and the emitter E of the second switch Q2 of the inverter circuit of the ballast that includes the fault condition detection circuit 320.

Thus, the fault detection condition circuit 320 operates without (i.e., devoid of) a controller as an isolated circuit to detect various lamp-related faults and discontinue energization of the lamps 106 in response thereto. For example, the fault detection circuit 320 detects a fault if a lamp 106 is operating in diode mode. In general, if a lamp 106 begins operating in diode mode, the lamp 106 starts jittering (flashing on and off) at a relatively high frequency, causing the intermittent sputtering of lamp current and the voltage across output transformer winding $L_4$ to oscillate at a relatively high frequency. The relatively high frequency of oscillation of the voltage across the transformer winding $L_4$ is correspondingly reflected in the voltage across the detect winding $L_6$. The increase in frequency of the voltage across the detect winding $L_6$ causes a threshold voltage to be generated across the capacitor C11, as discussed above. The threshold voltage is amplified by the operational amplifier OPAMP and provided to the shutdown circuit 230 for a finite period of time defined by the RC time constant.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast comprising:

an inverter circuit to selectively energize one or more lamps, the inverter circuit having a transformer to provide voltage to the one or more lamps, wherein the transformer comprises:

a core;

a primary winding wound on the core and connected to a direct current (DC) voltage bus; and a secondary winding wound on the core to connect to the one or more lamps; and a fault condition detection circuit connected to the inverter circuit to disable operation of the inverter circuit and thereby discontinue selective energization of the one or more lamps when a fault condition occurs, the fault condition detection circuit comprising:

an other primary winding wound on the core of the transformer to receive a voltage signal proportional to a voltage across the secondary winding, the other primary winding having a first terminal and a second terminal, wherein the second terminal of the other primary winding is connected to ground potential;

a voltage blocking circuit connected to the first terminal of the other primary winding to receive the voltage signal from the other primary winding, the voltage blocking circuit configured to selectively conduct and block the received voltage signal as a function of the frequency of the received voltage signal;

a capacitor connected between the voltage blocking circuit and the ground potential to receive the conducted voltage signal from the voltage blocking circuit and to store a voltage in response thereto;

wherein the voltage blocking circuit is configured to conduct the voltage signal received by the voltage blocking circuit and provide the conducted voltage signal to the capacitor when the frequency of the voltage signal received by the voltage blocking circuit exceeds a threshold frequency associated with normal operation of the one or more lamps;

wherein the voltage blocking circuit is configured to block the voltage signal received by the voltage blocking circuit when the frequency of the voltage signal received by the voltage blocking circuit is less than or equal to the threshold frequency associated with normal operation of the one or more lamps; and an output terminal connected to the inverter circuit to provide a disabling signal to the inverter circuit based on the voltage stored by the capacitor.

2. The ballast of claim 1, wherein the capacitor connected between the voltage blocking circuit and ground potential is a first capacitor, and wherein the voltage blocking circuit comprises a second capacitor and a diode, the second capacitor and the diode connected together in series.

3. The ballast of claim 1, wherein the fault condition detection circuit further comprises an operational amplifier connected between the capacitor and the output terminal to amplify the voltage stored by the capacitor.

4. The ballast of claim 3, wherein the operational amplifier is a differential operational amplifier having a non-inverting input terminal, an inverting input terminal, and an output terminal, and the fault condition detection circuit further comprises a voltage supply connected between the inverting input terminal of the operational amplifier and the ground potential, wherein the non-inverting input terminal of the operational amplifier is connected to the capacitor, and the output terminal of the operational amplifier is connected to the output terminal of the fault condition detection circuit.

5. The ballast of claim 4, wherein the fault condition detection circuit further comprises a diode connected between the output terminal of the operational amplifier and the output terminal of the fault condition detection circuit.

6. The ballast of claim 4, wherein the fault condition detection circuit further comprises a resistor-capacitor circuit connected between the output terminal of the operational amplifier and the output terminal of the fault condition detection circuit.

7. The ballast of claim 6, wherein the fault condition detection circuit further comprises a diode having an anode and a cathode, wherein the anode is connected to the output terminal of the operational amplifier and the cathode is connected to the resistor-capacitor circuit.

8. The ballast of claim 1, wherein the threshold frequency associated with normal operation is substantially 45 kilohertz.

9. The ballast of claim 1, further comprising:

a rectifier to receive an alternating current (AC) voltage signal from a power source and to produce a rectified voltage signal therefrom; and a power factor correction circuit to receive the rectified voltage signal and to provide a corrected voltage signal;

wherein the inverter circuit is connected to the power factor correction circuit via the DC voltage bus to receive the corrected voltage signal therefrom.

10. A ballast comprising:

an inverter circuit to selectively energize one or more lamps, the inverter circuit having a transformer to provide voltage to the one or more lamps, wherein the transformer comprises:

a core;

a primary winding wound on the core and connected to a direct current (DC) voltage bus; and a secondary winding wound on the core for connecting to the one or more lamps; and a fault condition detection circuit connected to the inverter circuit to disable operation of the inverter circuit and thereby discontinue energization of the one or more lamps when a fault condition occurs, the fault condition detection circuit comprising:

an other primary winding wound on the core of the transformer to receive a voltage signal proportional to a voltage across the secondary winding, the other primary winding having a first terminal and a second terminal, wherein the second terminal of the other primary winding is connected to ground potential;

a high pass filter connected to the first terminal of the other primary winding to receive the voltage signal from the other primary winding, the high pass filter configured to pass the received voltage signal when the received voltage signal has a frequency exceeding a threshold frequency associated with normal operation and to block the received voltage signal when the received voltage signal has a frequency less than or equal to the threshold frequency associated with normal operation;

a capacitor connected between the high pass filter and the ground potential to receive the voltage signal passed from the high pass filter and to store a voltage in response thereto; and an output terminal connected to the inverter circuit to provide a disabling signal to the inverter circuit based on the voltage stored by the capacitor.

11. The ballast of claim 10, wherein the capacitor connected between the high pass filter and the ground potential is a first capacitor, and the high pass filter comprises a second capacitor.

12. The ballast of claim 11, wherein a diode is connected between the first capacitor and the second capacitor.

13. The ballast of claim 10, wherein the fault condition detection circuit further comprises an operational amplifier connected between the capacitor and the output terminal to amplify the voltage stored by the capacitor.

14. The ballast of claim 13, wherein the operational amplifier is a differential operational amplifier having a non-inverting input terminal, an inverting input terminal, and an output terminal, and the fault condition detection circuit further comprises a voltage supply connected between the inverting input terminal of the operational amplifier and the ground potential, wherein the non-inverting input terminal of the operational amplifier is connected to the capacitor, and the output terminal of the operational amplifier is connected to the output terminal of the fault condition detection circuit.

15. The ballast of claim 14, wherein the fault condition detection circuit further comprises a resistor-capacitor circuit connected between the output terminal of the operational amplifier and the output terminal of the fault condition detection circuit.

16. The ballast of claim 14, wherein the fault condition detection circuit further comprises a diode connected between the output terminal of the operational amplifier and the output terminal of the fault condition detection circuit.

17. The ballast of claim 16, wherein the fault condition detection circuit further comprises a diode having an anode and a cathode, wherein the anode is connected to the output terminal of the operational amplifier and the cathode is connected to the resistor-capacitor circuit.

18. The ballast of claim 10, wherein the threshold frequency associated with normal operation is substantially 45 kilohertz.

19. A ballast comprising:

a rectifier to receive an alternating current (AC) voltage signal from a power source and to produce a rectified voltage signal therefrom;

a power factor correction circuit to receive the rectified voltage signal and to provide a corrected voltage signal;

an inverter circuit to receive the corrected voltage signal and to provide a lamp voltage to energize one or more lamps, the inverter circuit having a transformer to provide voltage to the one or more lamps, wherein the transformer comprises:

a core;

a primary winding wound on the core and connected to the power factor correction circuit; and a secondary winding wound on the core to connect to the one or more lamps; and a fault condition detection circuit connected to the inverter circuit to disable operation of the inverter circuit and thereby discontinue energization of the one or more lamps when a fault condition occurs, the fault condition detection circuit comprising:

an other primary winding wound on the core of the transformer to receive a voltage signal proportional to a voltage across the secondary winding, the other primary winding having a first terminal and a second terminal, wherein the second terminal of the other primary winding is connected to ground potential;

a high pass filter connected to the first terminal of the other primary winding to receive the voltage signal from the other primary winding, the high pass filter configured to pass the received voltage signal when the received voltage signal has a frequency exceeding a threshold frequency associated with normal operation and to block the received voltage signal when the received voltage signal has a frequency less than or equal to the threshold frequency associated with normal operation;

a capacitor connected between the high pass filter and the ground potential to receive the voltage signal passed from the high pass filter and to store a voltage in response thereto; and an output terminal connected to the inverter circuit to provide a disabling signal to the inverter circuit based on the voltage stored by the capacitor.

20. The ballast of claim 19, wherein the capacitor connected between the high pass filter and the ground potential is a first capacitor, and the high pass filter comprises a second capacitor, and wherein the ballast further comprises a diode connected between the first capacitor and the second capacitor.

* * * * *